US010141695B2

(12) United States Patent
Royer

(10) Patent No.: US 10,141,695 B2
(45) Date of Patent: Nov. 27, 2018

(54) ARC-FREE PLUG CONNECTOR

(71) Applicant: CommScope Technologies LLC, Hickory, NC (US)

(72) Inventor: Tyler Royer, York, PA (US)

(73) Assignee: COMMSCOPE TECHNOLOGIES LLC, Hickory, NC (US)

( * ) Notice: Subject to any disclaimer, the term of this patent is extended or adjusted under 35 U.S.C. 154(b) by 0 days.

(21) Appl. No.: 15/551,541

(22) PCT Filed: Feb. 16, 2016

(86) PCT No.: PCT/US2016/018059
§ 371 (c)(1),
(2) Date: Aug. 16, 2017

(87) PCT Pub. No.: WO2016/133898
PCT Pub. Date: Aug. 25, 2016

(65) Prior Publication Data

US 2018/0048098 A1 Feb. 15, 2018

Related U.S. Application Data

(60) Provisional application No. 62/117,104, filed on Feb. 17, 2015.

(51) Int. Cl.
*H01H 36/00* (2006.01)
*H01R 13/703* (2006.01)
(Continued)

(52) U.S. Cl.
CPC ..... *H01R 13/7037* (2013.01); *H01R 13/701* (2013.01); *H01R 24/28* (2013.01); *H01R 2103/00* (2013.01)

(58) Field of Classification Search
CPC ..... H01H 36/00–36/0066
(Continued)

(56) References Cited

U.S. PATENT DOCUMENTS 3,134,867 A 5/1964 Winship
3,400,348 A 9/1968 De Parry
(Continued)

OTHER PUBLICATIONS

International Search Report and Written Opinion of the International Searching Authority for corresponding International Patent Application No. PCT/US2016/018059 dated May 26, 2016, 10 pages.

*Primary Examiner* — Gary Paumen
(74) *Attorney, Agent, or Firm* — Merchant & Gould P.C.

(57) ABSTRACT

The electrical connection device includes: a housing, a first contact end, a second contact end, a first connector connectable to the first contact end, and a second connector connected to the second contact end. The electrical connection device may also include an electrical disconnection switch located between the first contact end and the first connector. In addition, the electrical connection device may also include a movable conduction engagement device that is moveable relative to the housing. The conduction engagement device also includes a magnetic element that moves free ends of the first contact end and the first connector of the electrical disconnection switch. The device also includes a mating electrical connection device including a first mating contact end and a second mating contact end, wherein the first and second contact ends make electrical contact with respective mating first and second contact ends of the mating electrical connection device.

20 Claims, 5 Drawing Sheets

(51) Int. Cl.

| | |
|---|---|
| ***H01R 13/70*** | (2006.01) |
| *H01R 103/00* | (2006.01) |
| *H01R 24/28* | (2011.01) |

(58) Field of Classification Search
USPC ..... 335/151–154, 205–207
See application file for complete search history.

(56) References Cited

U.S. PATENT DOCUMENTS

| | | | | |
|---|---|---|---|---|
| 7,264,494 | B2 | 9/2007 | Kennedy et al. | |
| 7,632,124 | B2 * | 12/2009 | Kennedy ..... | H01R 13/405 310/87 |
| 7,931,472 | B2 | 4/2011 | David et al. | |
| 8,864,528 | B2 * | 10/2014 | Chung ..... | H01R 13/6582 439/108 |
| 2007/0149013 | A1 | 6/2007 | Eastham et al. | |
| 2014/0062180 | A1 | 3/2014 | Demmerle et al. | |

* cited by examiner

ARC-FREE PLUG CONNECTOR

CROSS-REFERENCE TO RELATED APPLICATION

This application is a National Stage Application of PCT/US2016/018059, filed on Feb. 16, 2016, which claims the benefit of U.S. Patent Application Ser. No. 62/117,104, filed on Feb. 17, 2015, the disclosures of which are incorporated herein by reference in their entireties. To the extent appropriate, a claim of priority is made to each of the above disclosed applications.

BACKGROUND

Electrical connectors are used in various electrical systems to provide electrical conduction between components of the electrical systems. During a typical current conduction process, electric connectors are mated to their respective mating connectors such as receptacles to initiate electrical current flow. A particular concern occurs when electrical current arcs through the air between plug connectors and receptacles, prior to the plug connectors and receptacles becoming fully mated. Accordingly, there exists a need for an electrical connector assembly or system that can reduce electrical current arcing during the mating of electrical connectors to receptacles or other connectors.

SUMMARY

In one aspect, the technology relates to an electrical connection device. The electrical connection device comprises a housing, a first contact end, a second contact end, a first connector connectable to the first contact end, and a second connector connected to the second contact end. The electrical connection device may also comprise an electrical disconnection switch located between the first contact end and the first connector which connects the first contact end and the first connector in a first state, and disconnects the first contact end and the first connector in a second state. In addition, the electrical connection device may comprise a movable conduction engagement device that is moveable relative to the housing which changes the electrical disconnection switch from the first and second states.

The conduction engagement device may comprise a magnetic element that moves free ends of the first contact end and the first connector of the electrical disconnection switch into electrical contact in the first state, wherein the free ends are held by the magnetic element in electrical contact in the first state, and wherein the free ends are allowed to separate when the movable conduction engagement device is moved so as to move the magnetic element a distance away from the free ends in the second state.

Another aspect of the present disclosure relates to a method of conducting electricity through an electrical conduction device. The method includes aligning contact ends of an electrical connection device with the respective mating contact ends of a mating electrical connection device. After alignment, the contact ends of the electrical connection device are connected to the mating contacts of the mating electrical connection device. A conduction engagement device is provided as part of the electrical connection device. The conduction engagement device is engaged when it moves to a location on the electrical connection device, wherein a magnetic element in the conduction engagement device causes a first electrical terminal member and second electrical terminal member in an electrical disconnection switch in the electrical connection device to physically connect. An electrical current is sent through the electrical connection device.

Another aspect of the present disclosure relates to an electrical connection system. An electrical connection device comprises a housing, a first contact end, a second contact end, a first connector connectable to the first contact end, and a second connector connected to the second contact end. The electrical connection device may also comprise an electrical disconnection switch located between the first contact end and the first connector which connects the first contact end and the first connector in a first state, and disconnects the first contact end and the first connector in a second state. The electrical connection device may also comprise a movable conduction engagement device that is moveable relative to the housing which changes the electrical disconnection switch from the first and second states.

The conduction engagement device also comprises a magnetic element that moves free ends of the first contact end and the first connector of the electrical disconnection switch into electrical contact in the first state, wherein the free ends are held by the magnetic element in electrical contact in the first state, and wherein the free ends are allowed to separate when the movable conduction engagement device is moved so as to move the magnetic element a distance away from the free ends in the second state.

The system also comprises a mating electrical connection device comprising a first mating contact end and a second mating contact end, wherein the electrical connection device is connectable to the mating electrical connection device in two steps, a first step wherein the first and second contact ends make electrical contact with respective mating first and second contact ends of the mating electrical connection device while the electrical disconnection switch is in the second state, and a later second step wherein the movable conduction engagement device moves the free ends of the electrical disconnection switch into electrical contact in the first state.

BRIEF DESCRIPTION OF THE DRAWINGS

There are shown in the drawings, embodiments which are presently preferred, it being understood, however, that the technology is not limited to the precise arrangements and instrumentalities shown.

DETAILED DESCRIPTION

Reference will now be made in detail to the exemplary aspects of the present disclosure that are illustrated in the accompanying drawings. Wherever possible, the same reference numbers will be used throughout the drawings to refer to the same or like structure.

Figure 1:
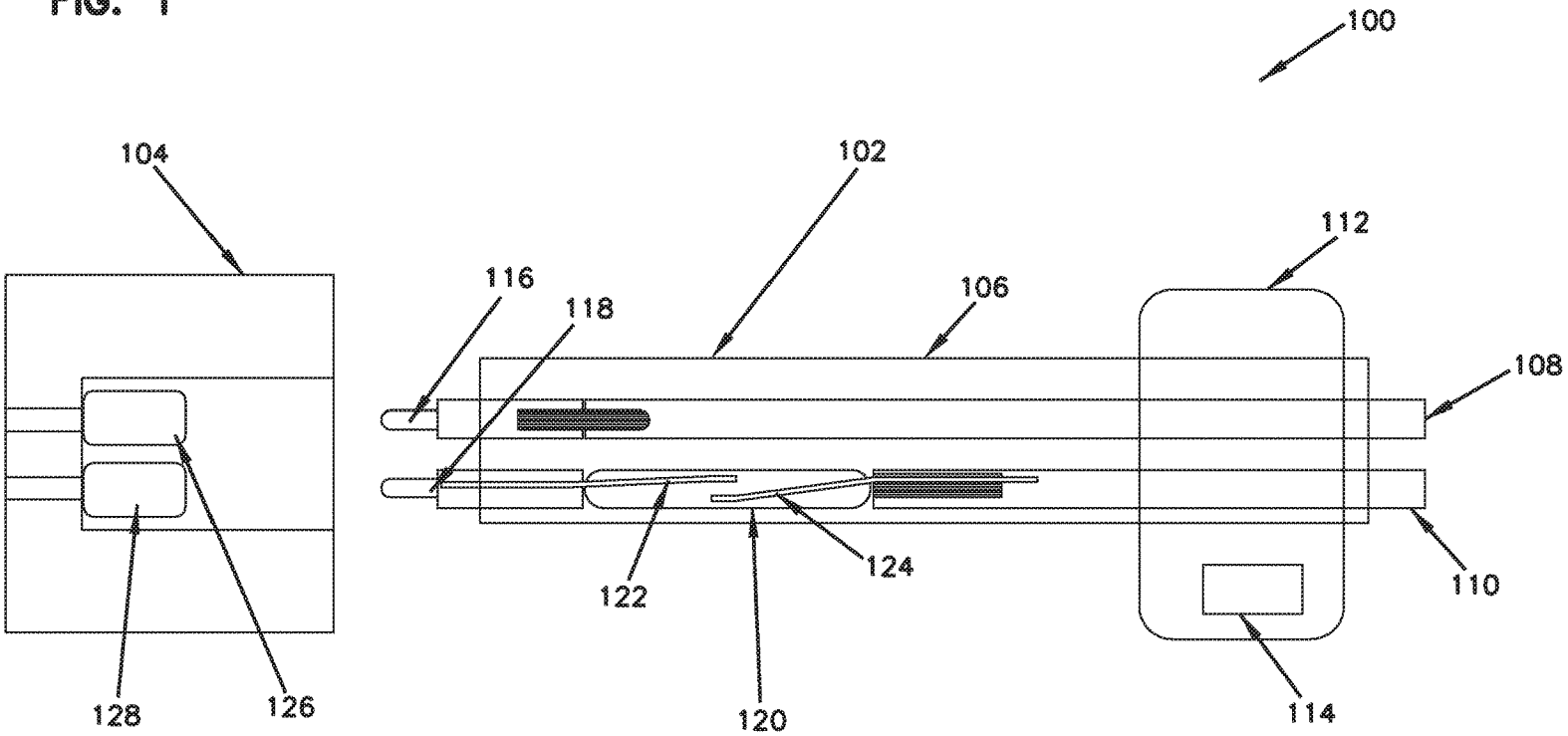
FIG. 1 is a schematic of an electrical connection device system.

FIG. 1 depicts a schematic of an electrical connection system 100. The system 100 includes an electrical connection device 102 and a mating electrical connection device 104. In one embodiment, the electrical connection device 102 and the mating electrical connection device 104 can align and engage to each other at contact ends. The electrical connection device 102 may comprise a first contact end 118 and a second contact end 116. The mating electrical connection device 104 may comprise a first mating contact end 128 and a second mating contact end 126. Thus in order to initiate electrical conduction, the first contact end 118 can engage the first mating contact end 128, the second contact end 116 can engage the second mating contact end 126.

First contact end 118 and second contact end 116 can be in the form of pins. First mating contact end 128 and second mating contact end 126 can be in the form of sockets.

As depicted in FIG. 1, the electrical connection device may further comprise a housing 106 and a conduction engagement device 112. In an embodiment, the housing 106 may be made of a polymer material. In another embodiment the housing 106 may be a metallic composition where the metallic composition may be coated with a polymer to reduce potential electrical conduction and radiant heat generated through electrical conduction. In another embodiment, the housing 106 may be configured to be a unitary piece formed around internal components. In a further embodiment, the housing 106 may be configured from a plurality of pieces that can be configured to lock together during use. In addition, the embodiment with the multi-piece housing 106 may also be configured to separate and provide access to components encompassed by the housing 106.

As depicted in FIG. 1, the housing may encompass and protect multiple components, including: the first contact end 118, the second contact end 116, a first connector 110, a second connector 108, and an electrical disconnection switch 120. In one aspect of the disclosure, the second contact end 116 may be connected to the second connector 108. Further, the electrical disconnection switch 120 may be placed between the first contact end 118 and the first connector 110. In another embodiment, the second connector 108 may be a ground connector and the first connector 110 may be a live current connector.

As discussed earlier regarding the embodiment in FIG. 1, the electrical disconnection switch 120 may be placed between and connected to the first contact end 118 and the first connector 110. In an aspect of the disclosure, the electrical disconnection switch 120 comprises an enclosure 200 where the enclosure encompasses a first electrical terminal member 122 and a second terminal member 124. In an example, the first and second electrical terminal members are comprised of an electricity conducting material. Accordingly, when the first electrical terminal member 122 and the second electrical terminal member are in physical contact, electrical current can flow through the electrical connection device 102 to the mating electrical connection device 104 and vice versa depending on the direction of electrical current flow. An additional embodiment of the electrical disconnection switch is discussed in FIG. 2.

In addition FIG. 1 also depicts a conduction engagement device 112. In one aspect of the disclosure, the conduction engagement device 112 may further comprise a magnet 114. The magnet 114 may be placed on an exterior surface or interior surface of the conduction engagement device 112. In another embodiment, the magnet 114 may be within the cross section of the conduction engagement device 112. Regardless of the location of the magnet 114 relative to the conduction engagement device 112, the strength of the magnet 114 may produce a magnetic field that should force the first electrical terminal member 122 and second electrical terminal member 124 to move into contact with each other. In one embodiment, the magnet may be a permanent magnet. In an alternate embodiment, the magnet may be an electromagnet.

In an embodiment, the conduction engagement device 112 can be an annulus that is configured to move along an axis of the housing 106, parallel to the first connector 110 and second connector 108. In an alternate embodiment, the conduction engagement device 112 may be tethered to the housing 106. In the tethering example, a tether may be used to connect the housing 106 and the conduction engagement device 112. The tethered connection will be the only restriction in the range of motion for the conduction engagement device, and the engagement device motion will not be restricted to move along an axis of the housing 106. In a further embodiment, the conduction engagement device 112 may be configured to open and close to encompass the housing 106 in the appropriate proximity to the electrical disconnection switch 120.

Regarding material composition, the engagement device 112 may be comprised of a rigid polymer. In another embodiment, the conduction engagement device 112 may comprise a movable magnet instead of a magnet 114 being encompassed in a conduction engagement device composed of a different material. In this example, the electrical terminal members 122, 124 in the electrical disconnection switch 120 may be configured to physically connect when encompassed by a magnetic field.

In another aspect of the disclosure, the conduction engagement device 112 may also comprise a locking mechanism. A function of the locking mechanism seeks to ensure that that the magnet 114 stays in proximity to the electrical disconnection switch 112 in order to maintain an electrical connection between the first electrical terminal member 122 and the second electrical terminal member 124. In one embodiment, the locking mechanism of the conduction engagement device may comprise grooves in the inner surface in the conduction engagement device 112 that respectively mate with a grooved surface on the exterior surface of the housing 106. Thus, the mated grooved surfaces may allow the conduction engagement device 112 to be screwed on to the housing 106 at the appropriate region, reducing potential slippage of the conduction engagement device 112 on the housing 106. In another embodiment, the conduction engagement device 112 may have a latch that sets in a notch on the housing 106. In such an embodiment, the location of the notch and latch locking mechanism may be configured to properly align the magnet 114 with the first electrical terminal member 122 and second terminal member 124.

The locking mechanism may also hold the electrical connection device 102 to the mating electrical connection device 104.

Figure 2:
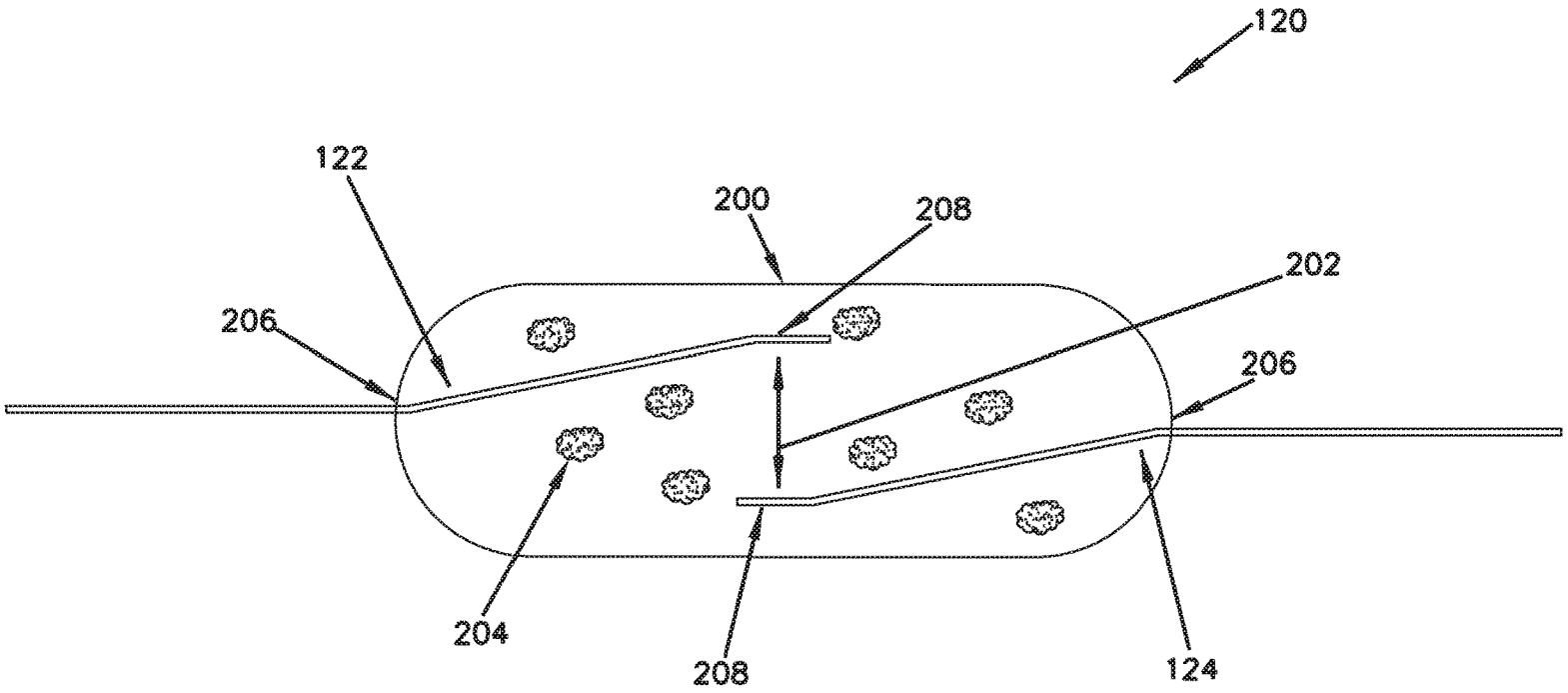
FIG. 2 is a schematic of a component of the electrical connection device system.

FIG. 2 depicts a schematic of the electrical disconnection switch 120, as discussed earlier. In an embodiment, the electrical disconnection switch 120 comprises an enclosure 200 where the enclosure encompasses a first electrical terminal member 122 and a second terminal member 124. In an example embodiment, electrical current flows in the electrical connection device to the mating electrical connection device when the first electrical terminal member 122 and the second electrical terminal member 124 are in physical contact. In another embodiment the enclosure is sealed to enclose an inert gas 204 to further reduce the likelihood of unintentional electrical current flow. A physical property of the inert gas 204 indicates that there are no free electrons in the gas atoms. This property of the inert gas 204 reduces the possibility of electrical current arcing through a gap between the first electrical terminal member 122 and the second electrical terminal member 124.

As discussed earlier, when the conduction engagement device 112 is in proximity to the electrical disconnection switch 120, the magnet 114 in the conduction engagement device 112 causes the first electrical terminal member 122 and the second electrical terminal member 124 to come in contact. In one embodiment, the magnetic force may cause the first electrical terminal member 122 and the second electrical terminal member 124 to rotate about a base end 206. Both terminal members have a base end 206 that may be restricted by the edges of the enclosure 200. In addition, the first electrical terminal member 122 and the second electrical terminal member 124 have a free end 208. When there is no electrical current flowing, the electrical disconnection switch is disengaged. In the disengaged state, the first electrical terminal member 122 and the second electrical terminal member 124 may be structurally configured so that the free ends 208 are set at a predetermined non-engagement displacement 202. In another embodiment, the spring constant of the second electrical terminal member 124 may be higher than the spring constant of the first electrical terminal member 122. A higher spring constant of the second electrical terminal member 124 increases the stiffness of the second electrical terminal member 124. Thus, the movement of the free end 208 of the first electrical terminal member 122 from the initial displacement 202 may be greater when subjected to the magnetic force of the magnet 114. Varying the stiffness between the two electrical terminal members may ensure that the non-engagement displacement 202 will decrease and result in contact of both free ends 208, when the electrical disconnection device 120 is placed in a magnetic field. Accordingly, depending on the placement of the magnet 114, another configuration may use a first electrical terminal member 122 with a higher spring constant than the second electrical terminal member 124.

Figure 3A:
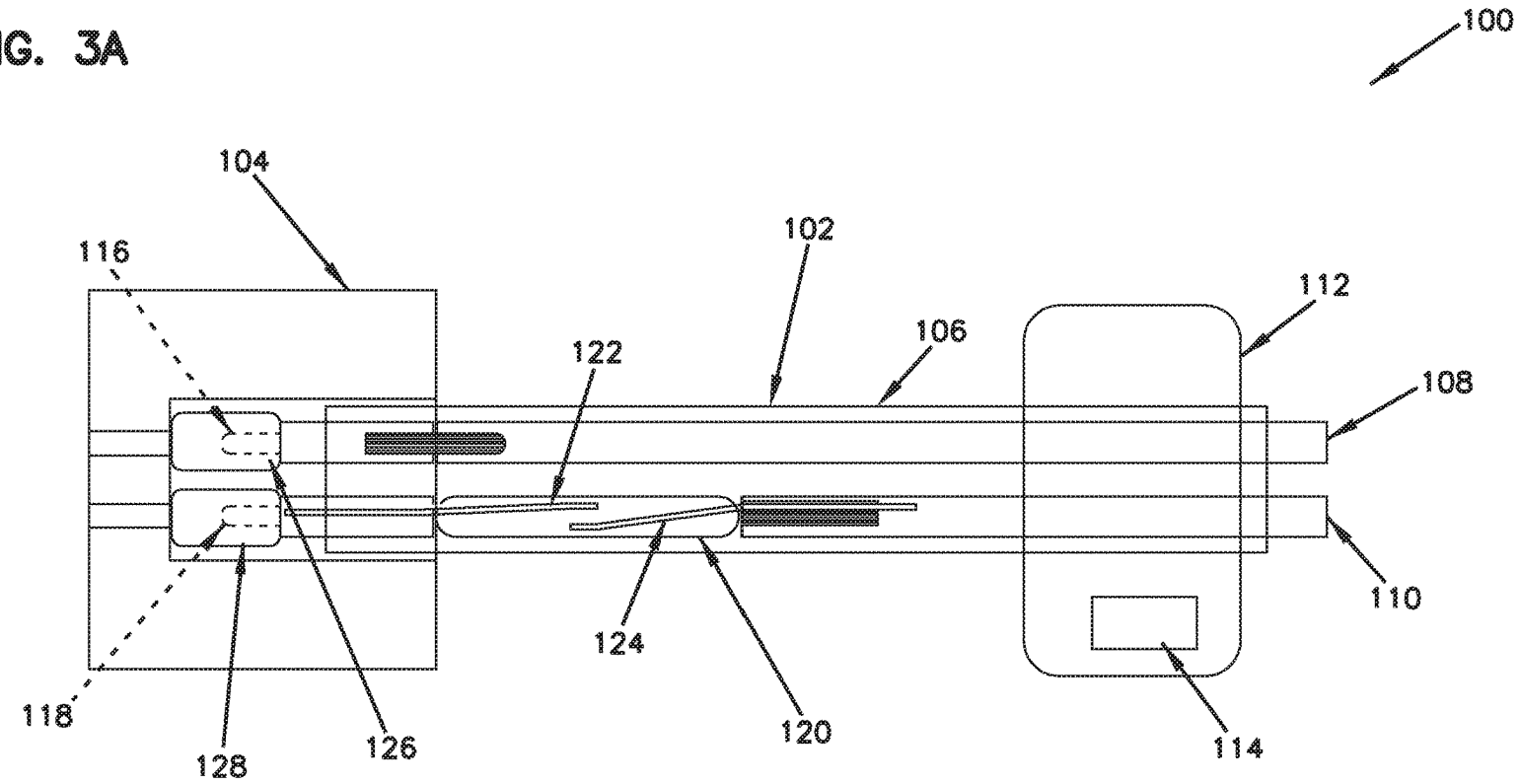
FIGS. 3A-3C is a schematic depicting the process initiating electrical conduction through the electrical connection device system.
Figure 3B:
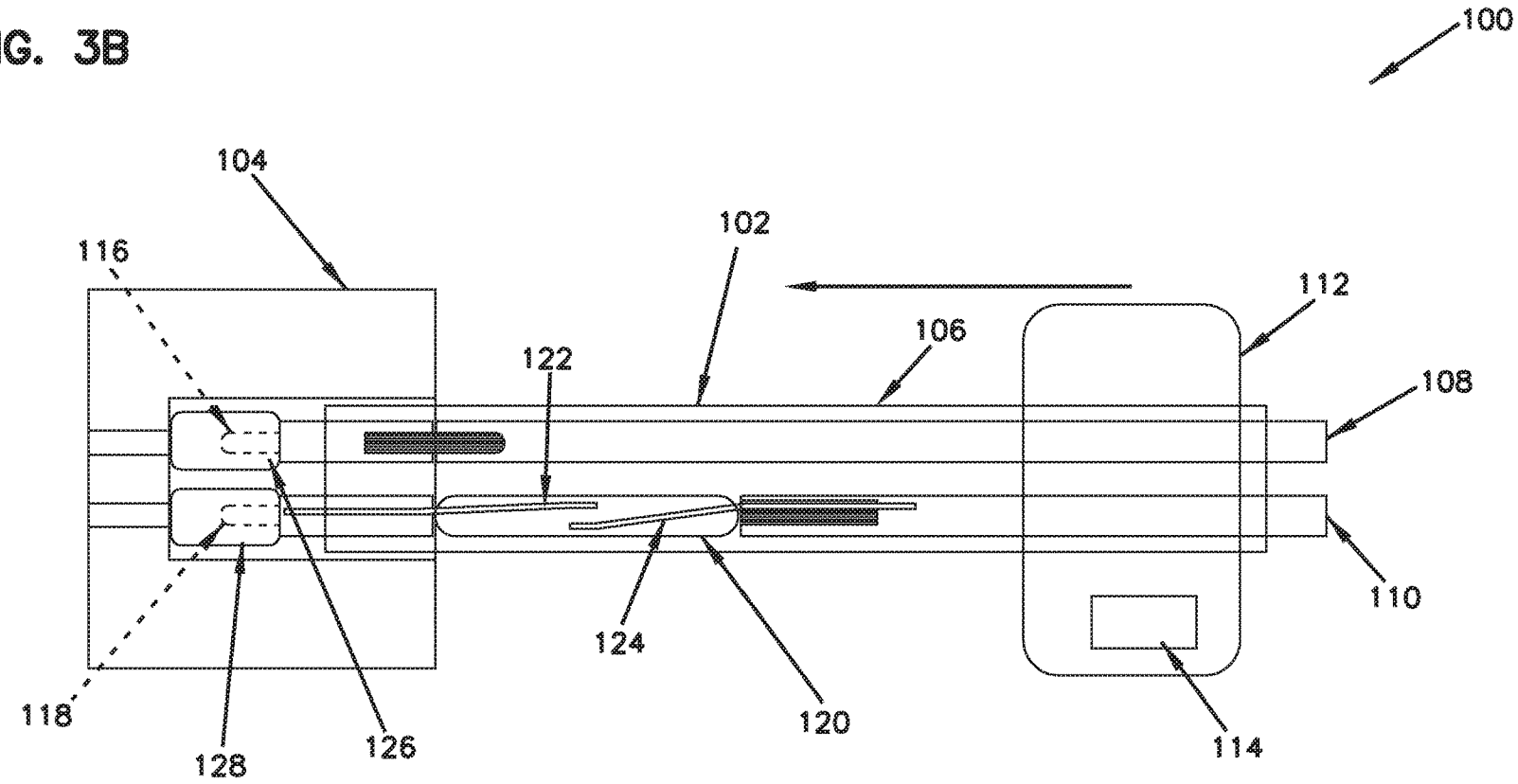
Figure 3C:
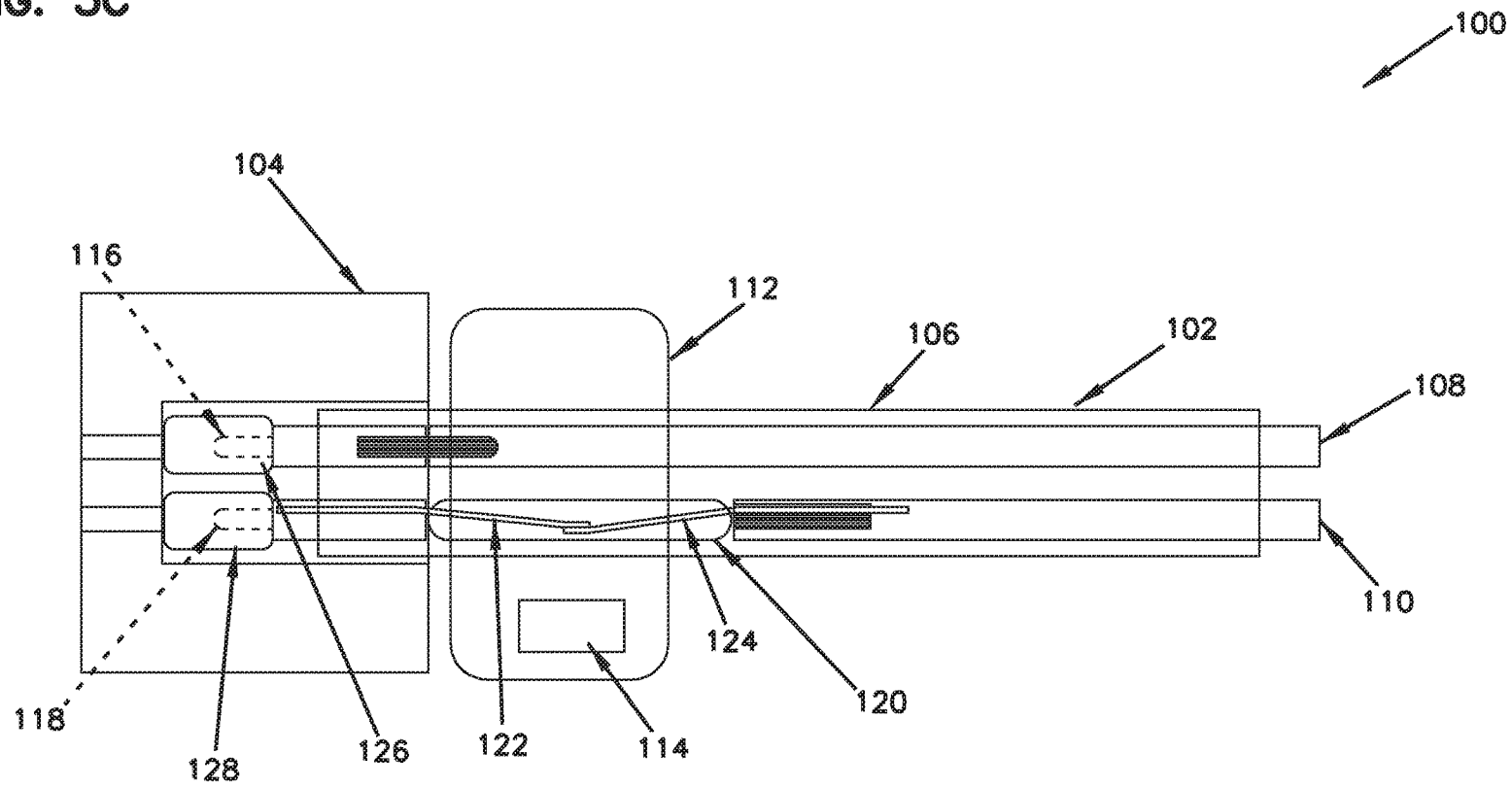

The schematics in FIGS. 3A-3C depict steps in a process of conducting electricity between the electrical connection device 102 and the mating electrical connection device 104. FIG. 3A depicts a mating step. During the mating step, the first contact end 118 and the second contact end 116 are aligned with the respective first mating contact end 128 and the second mating contact end 126. The mating step may be completed when the first contact end 118 is connected to the first mating contact end 128 and second contact end 116 is connected to the second mating contact end 126.

FIG. 3B depicts an engaging step. In an embodiment, the engaging step may comprise moving the conduction engagement device 112 in proximity to the electrical disconnection switch 120. In another embodiment, moving the conduction engagement device 112 may comprise translating the conduction engagement device 112 along an axis of the housing 106. Depending on the configuration of the housing 106, alternate forms of motion may be used move the conduction engagement device 112 relative to the housing 106. The alternate forms of motion may comprise twisting, rotating or tethering. The engagement step may be completed when the conduction engagement device 112 is moved to a location on the housing 106 where the magnet 114 is configured to exert a magnetic force on the first electrical terminal member 122 and the second terminal member 124 of the electrical disconnection switch 120.

FIG. 3C depicts the power connection step. At the conclusion of the engaging step depicted in FIG. 3B, the magnet 114 causes the electrical terminal members to physically contact. Thus, in the power connection step, there may no longer be a shorted connection in the electrical disconnection switch 120. Accordingly, electricity is permitted to flow through the system 100. In another embodiment, power connection may also comprise locking the conduction engagement device 112 to the housing 106. The mechanism to lock the conduction engagement device 112 on the housing 106 may be used to ensure that the conduction engagement device 112 does not move the magnet 114 away from the location necessary for the magnet 114 to force the electrical terminal members to remain in physical contact.

The electrical connection device 102 can be included in an electrical only cable or other electrical only connection. In one embodiment, the electrical connection device 102 is in the form of a plug, and the mating electrical connection device 104 is in the form of a socket or a receptacle.

Device 102 can be part of high-voltage hybrid optical/electrical connectivity solution when both power and fiber signals are provided by the same cable. The device 102 could also be used as an interlock to power off a laser source as well, limiting optical reflections or unsafe optical power when disconnected.

While there have been described herein what are to be considered exemplary and preferred embodiments of the present technology, other modifications of the technology will become apparent to those skilled in the art from the teachings herein. The particular methods of manufacture and geometries disclosed herein are exemplary in nature and are not to be considered limiting. It is therefore desired to be secured in the appended claims all such modifications as fall within the spirit and scope of the technology. Accordingly, what is desired to be secured by Letters Patent is the technology as defined and differentiated in the following claims, and all equivalents.

What is claimed is:

1. An electrical connection device comprising:

a housing;

a first contact end;

a second contact end;

a first connector connectable to the first contact end;

a second connector connected to the second contact end;

wherein the housing covers at least a portion of each of the first contact end, the second contact end, the first connector and the second connector;

an electrical disconnection switch between the first contact end and the first connector which connects the first contact end and the first connector in a first state, and disconnects the first contact end and the first connector in a second state; and a movable conduction engagement device positioned exteriorly to the housing and moveable relative to the housing which changes the electrical disconnection switch from the first and second states, wherein a magnetic element moves free ends of the first contact end and the first connector of the electrical disconnection switch into electrical contact in the first state, wherein the free ends are held by the magnetic element in electrical contact in the first state, and wherein the free ends are allowed to separate when the movable conduction engagement device is moved so as to move the magnetic element a distance away from the free ends in the second state.

2. The electrical connection device according to claim 1, wherein the electrical disconnection switch comprises an enclosure having a first end and a second end, wherein the enclosure encompasses a first electrical terminal member and a second electrical terminal member, wherein the first electrical terminal member is comprised of a base end and a free end, and wherein the second electrical terminal member is comprised of a base end and a free end, wherein the base end of the first electrical terminal member is connected to the first end of the enclosure and the base end of the second electrical terminal member is connected to the second end of the enclosure.

3. The electrical connection device according to claim 2, wherein the enclosure further encompasses an inert gas where the inert gas encompasses the first electrical terminal member and the second electrical terminal member.

4. The electrical connection device according to claim 2, wherein the first electrical terminal member and the second electrical terminal member comprise an electro-conductive and magnetic material.

5. The electrical connection device according to claim 4, wherein the first electrical terminal member and the second electrical terminal member are composed of a material with a spring constant that will allow the first electrical terminal member and the second electrical terminal member to move to the first state by the conduction engagement device and return to a displaced configuration when the conduction engagement device is in the second state.

6. The electrical connection device of claim 5, wherein the electrical disconnection switch is configured to displace the free ends of the first electrical terminal member and the second electrical terminal member when the conduction engagement device is in the second state.

7. The electrical connection device of claim 2, wherein the movable conduction engagement device comprises a magnetic element wherein the magnetic element is configured with sufficient flux to force the free ends of the first electrical terminal member and the second electrical terminal member to connect when the conduction engagement device is in the first state, wherein the movable conduction engagement device is coupled to an exterior of the housing, and wherein the movable conduction engagement device is restricted to move along an axis of the housing.

8. The electrical connection device of claim 7, wherein the magnetic element is a permanent magnet.

9. The electrical connection device of claim 7, wherein the magnetic element is an electro-magnet.

10. The electrical connection device of claim 1, where the first connector is a grounding connector and the second connector is a powered connector.

11. The electrical connection device of claim 7, wherein the electrical disconnection switch is in the first state when the conduction engagement device encompasses the enclosure of the electrical disconnection switch.

12. The electrical connection device of claim 7, wherein the electrical disconnection switch is in the first state when the magnetic element in the conduction engagement device causes the first electrical terminal member and the second electrical terminal member in the electrical disconnection switch to connect.

13. The electrical connection device of claim 1, wherein one of the first and second connectors is associated with a grounding line, wherein the other of the first and second connectors is associated with a power line, and wherein the electrical disconnection switch is located on the power line.

14. A method of sending electrical current through an electrical connection device, wherein engaging electrical current comprises:

aligning a first contact end of an electrical connection device with a first mating contact end of a mating electrical connection device and a second contact end of the electrical connection device with a second mating contact end of the mating electrical connection device;

connecting the first contact end of the electrical connection device with the first mating contact end of the mating electrical connection device and the second contact end of the electrical connection device with a second mating contact end of the mating electrical connection device;

engaging a conduction engagement device with the electrical connection device, wherein the engaging comprises moving the conduction engagement device to a location on an exterior of a housing of the electrical connection device, wherein a magnetic element in the conduction engagement device causes a first electrical terminal member and a second electrical terminal member in an electrical disconnection switch in the electrical connection device to physically connect; and sending an electrical current through the electrical connection device.

15. The method of claim 14, wherein the moving comprises translating the conduction engagement device along an axis of one of the connectors.

16. The method of claim 14, wherein the moving comprises rotating the conduction engagement device along an axis of the connector.

17. The method of claim 14, further comprising securing the conduction engagement device on the exterior of the housing of the electrical connection device to prevent movement.

18. The method of claim 17, wherein the securing comprises activating a locking mechanism to decrease movement of the conduction engagement device.

19. An electrical connection device comprising:

a housing;

a first contact end;

a second contact end;

a first connector connectable to the first contact end;

a second connector connected to the second contact end;

wherein the housing covers at least a portion of each of the first contact end, the second contact end, the first connector and the second connector;

an electrical disconnection switch between the first contact end and the first connector which connects the first contact end and the first connector in a first state, and disconnects the first contact end and the first connector in a second state;

a movable conduction engagement device positioned exteriorly to the housing and moveable relative to the housing which changes the electrical disconnection switch from the first and second states, wherein a magnetic element moves free ends of the first contact end and the first connector of the electrical disconnection switch into electrical contact in the first state, wherein the free ends are held by the magnetic element in electrical contact in the first state, and wherein the free ends are allowed to separate when the movable conduction engagement device is moved so as to move the magnetic element a distance away from the free ends in the second state; and a mating electrical connection device comprising:

a first mating contact end; and a second mating contact end;

wherein the electrical connection device is connectable to the mating electrical connection device in two steps, a first step wherein the first and second contact ends make electrical contact with respective mating first and second contact ends of the mating electrical connection device while the electrical disconnection switch is in the second state, and a later second step wherein the movable conduction engagement device moves the free ends of the electrical disconnection switch into electrical contact in the first state.

20. An electrical connection device comprising:

a housing;

a first contact end;

a second contact end;

a first connector connectable to the first contact end;

a second connector connected to the second contact end;

wherein the housing covers at least a portion of each of the first contact end, the second contact end, the first connector and the second connector;

an electrical disconnection switch between the first contact end and the first connector which connects the first contact end and the first connector in a first state, and disconnects the first contact end and the first connector in a second state;

a movable conduction engagement device positioned exteriorly to the housing and moveable relative to the housing which changes the electrical disconnection switch from the first and second states, wherein a magnetic element moves free ends of the first contact end and the first connector of the electrical disconnection switch into electrical contact in the first state, wherein the free ends are held by the magnetic element in electrical contact in the first state, and wherein the free ends are allowed to separate when the movable conduction engagement device is moved so as to move the magnetic element a distance away from the free ends in the second state;

wherein the electrical connection device is connectable to a mating electrical connection device in two steps, a first step wherein the first and second contact ends make electrical contact with respective mating first and second contact ends of the mating electrical connection device while the electrical disconnection switch is in the second state, and a later second step wherein the movable conduction engagement device moves the free ends of the electrical disconnection switch into electrical contact in the first state.

* * * * *